US007605703B2

(12) United States Patent
Nichols, Sr.

(10) Patent No.: US 7,605,703 B2
(45) Date of Patent: Oct. 20, 2009

(54) INTERMEDIATE COVER BOARD WITH CONCEALED SECURITY DEVICE FOR HARD COVER PRODUCT

(75) Inventor: Dale Hunt Nichols, Sr., Brentwood, TN (US)

(73) Assignee: Smartguard, LLC, Nashville, TN (US)

( * ) Notice: Subject to any disclaimer, the term of this patent is extended or adjusted under 35 U.S.C. 154(b) by 32 days.

(21) Appl. No.: 11/593,314

(22) Filed: Nov. 6, 2006

(65) Prior Publication Data

US 2007/0052228 A1 Mar. 8, 2007

Related U.S. Application Data

(63) Continuation of application No. 10/886,355, filed on Jul. 7, 2004, now Pat. No. 7,183,918.

(60) Provisional application No. 60/562,586, filed on Apr. 14, 2004.

(51) Int. Cl.
*G08B 13/14* (2006.01)

(52) U.S. Cl. ..... 340/572.1; 340/572.4; 340/572.8; 340/539.1; 340/541; 340/693.9; 340/825.69; 340/825.72

(58) Field of Classification Search ..... 340/572.1, 340/572.3, 572.4, 572.8, 539.1, 540, 541, 340/693.5, 693.9, 825.69, 825.72, 693.12; 235/382, 487, 492

See application file for complete search history.

(56) References Cited

U.S. PATENT DOCUMENTS 3,938,831 A 2/1976 Herman
4,709,813 A 12/1987 Wildt ..... 206/312
4,784,264 A 11/1988 Sykes ..... 206/387
4,881,061 A 11/1989 Chambers
4,966,020 A 10/1990 Fotheringham et al. ..... 70/276
5,031,756 A 7/1991 Buzzard et al. ..... 206/1.5
5,209,086 A 5/1993 Brühwiler ..... 70/57.1
5,236,081 A 8/1993 Fitzsimmons et al. ..... 206/44

(Continued)

FOREIGN PATENT DOCUMENTS

CN 2559492 Y 7/2003

(Continued)

OTHER PUBLICATIONS

International Search Report, PCT/US05/13105 (Jan. 31, 2007).

(Continued)

*Primary Examiner*—Hung T. Nguyen
(74) *Attorney, Agent, or Firm*—Baker Donelson Bearman Caldwell & Berkowitz, PC

(57) ABSTRACT

An intermediate cover board for assembly of bard cover products, in which a primary sheet having a first thickness and opposing planar surfaces defines an opening in a selected portion of the sheet. The opening receives a security device. A pair of opposing secondary sheets each having a second thickness less than the first thickness laminate to the opposing planar surfaces of the primary sheet, so that the security device is enclosed between the laminated secondary sheets that do not display surface indications of the presence of the security device. A method of making the intermediate laminated cover board and a hard cover product made with the intermediate laminated cover board are disclosed.

11 Claims, 8 Drawing Sheets

U.S. PATENT DOCUMENTS

| | | | | |
|---|---|---|---|---|
| 5,260,690 | A | 11/1993 | Mann et al. | |
| 5,276,435 | A | 1/1994 | Rossides | 340/691 |
| 5,297,672 | A | 3/1994 | MacTavish | 206/1.5 |
| 5,331,313 | A | 7/1994 | Koning | |
| 5,440,296 | A | 8/1995 | Nelson | |
| 5,477,219 | A | 12/1995 | Zarembo et al. | |
| 5,500,640 | A | 3/1996 | Zhou et al. | |
| 5,598,728 | A | 2/1997 | Lax | 70/276 |
| 5,620,271 | A | 4/1997 | Bergh et al. | 402/79 |
| 5,656,998 | A | 8/1997 | Fujiuchi et al. | 340/571 |
| 5,680,782 | A | 10/1997 | Komatsu et al. | 70/54.1 |
| 5,718,332 | A | 2/1998 | Tachibana | 206/308.2 |
| 5,745,036 | A | 4/1998 | Clare | |
| 5,749,735 | A | 5/1998 | Redford et al. | 434/307 |
| 5,762,377 | A | 6/1998 | Chamberlain | 283/67 |
| 5,782,350 | A | 7/1998 | Weisburn et al. | 206/308.2 |
| 5,802,890 | A | 9/1998 | Espada-Velasco | 70/57.1 |
| 5,812,065 | A | 9/1998 | Schrott et al. | 340/825.54 |
| 5,823,341 | A | 10/1998 | Nakasuji | 206/387.11 |
| 5,847,649 | A | 12/1998 | Collins et al. | |
| 5,850,752 | A | 12/1998 | Lax | 70/276 |
| 5,882,052 | A | 3/1999 | Whitehead | 292/80 |
| 5,910,770 | A | 6/1999 | Ohara | 340/572.5 |
| 5,984,388 | A | 11/1999 | Bacon | 292/307 R |
| 5,988,376 | A | 11/1999 | Lax | 206/308.2 |
| 6,082,156 | A | 7/2000 | Bin | 70/57.1 |
| 6,094,137 | A | 7/2000 | Rasch et al. | |
| 6,100,804 | A | 8/2000 | Brady et al. | |
| 6,142,697 | A | 11/2000 | Williams | 402/31 |
| 6,155,087 | A | 12/2000 | Necchi | 70/57.1 |
| 6,222,453 | B1 | 4/2001 | Joyce | 340/572.8 |
| 6,244,462 | B1 | 6/2001 | Ehrensvärd et al. | 221/7 |
| 6,276,523 | B2 | 8/2001 | Sanders | |
| 6,374,648 | B1 | 4/2002 | Mitsuyama | 70/57.1 |
| 6,497,125 | B1 | 12/2002 | Necchi | 70/57.1 |
| 6,601,415 | B2 | 8/2003 | Takinami | 70/57.1 |
| 6,614,750 | B2 | 9/2003 | Weber et al. | 369/290 |
| 6,616,035 | B2 | 9/2003 | Ehrensvärd et al. | 235/380 |
| 6,619,079 | B2 | 9/2003 | Cheung | 70/57.1 |
| 6,628,199 | B1 | 9/2003 | Ehrensvärd et al. | 340/568.1 |
| 6,888,509 | B2 | 5/2005 | Atherton | 343/718 |
| 6,937,153 | B2 | 8/2005 | Redlin | 340/572.8 |
| 6,947,371 | B2 | 9/2005 | Bigley | 369/290.1 |
| 7,008,134 | B2 | 3/2006 | Lane | 402/73 |
| 7,059,535 | B2 * | 6/2006 | Rietzler | 235/492 |
| 7,298,343 | B2 * | 11/2007 | Forster et al. | 343/767 |
| 2002/0134119 | A1 | 9/2002 | Derman | 70/58 |
| 2002/0149479 | A1 | 10/2002 | Duschek et al. | 340/572.1 |
| 2002/0196126 | A1 | 12/2002 | Eisenberg et al. | 340/10.2 |
| 2003/0019770 | A1 | 1/2003 | Hodes | 206/308.2 |
| 2003/0094021 | A1 | 5/2003 | Takinami | 70/57.1 |
| 2003/0131638 | A1 | 7/2003 | Chang | 70/57.1 |
| 2003/0145635 | A1 | 8/2003 | Sheslow | 70/57.1 |
| 2003/0168514 | A1 | 9/2003 | Rancien et al. | |
| 2003/0234190 | A1 | 12/2003 | Kuo | 206/308.2 |
| 2004/0008613 | A1 | 1/2004 | Beckwith et al. | 369/291 |
| 2004/0066029 | A1 | 4/2004 | Parker | |
| 2004/0066030 | A1 | 4/2004 | Parker | |
| 2006/0116899 | A1 * | 6/2006 | Lax et al. | 705/1 |

FOREIGN PATENT DOCUMENTS

| | | | |
|---|---|---|---|
| DE | 3212039 | A1 | 10/1983 |
| DE | 4226237 | A1 | 2/1994 |
| FR | 2746191 | A1 | 9/1997 |
| WO | WO 9315294 | | 5/1993 |
| WO | 9524703 | | 9/1995 |

OTHER PUBLICATIONS

"*The Henderson Network*"; web page article from http://www.cypak.com/index.php?a=pressroom&b=newscomdex021121;Aug. 18, 2004; www.cypak.com, Cypak AB, Funckens Gränd 1, Box 2332, 103 18 Stockholm, Sweden.

"Roland Piquepaille's Technology Trends"; "*Cypak Mounts CPUs On Paper. Can Disposable PC's be far off?*"; web page article from http://radio.weblogs.com/0105910/2003/02/03.html; Jan. 3, 2004.

RFID Journal "*The Package Is the Computer*"; web page article from http://www.rfidjournal.com/article/view/301; Feb. 11, 2003.

"*04 01 13 Cypak signs agreement to license proprietary intelligent pharmaceutical packaging technology to MeadWestvaco Healthcare Packaging*;" web page article from http://.cypak.com?test_site/index.php?a=pressroom&b=news&page=news_meadwestvaco 04 . . . ; Jan. 13, 2004; www.cypak.com, Cypak, AB, Funkens Gränd 1, Box 2332, 103 18 Stockholm, Sweden.

MeadWestvaco, Healthcare Packaging, announcement, New York, NY Apr. 2, 2004, "*MeadWestvaco Healthcare Packaging enhance electronic compliance packaging offering using Cypak AB Products*".

Smart Healthcare USA 2004, "*RFID and Smart Packaging in healthcare*"; web page article from http://www.idtechex.com/smarthealthcareusa/4.asp; Jun. 10-11, 2004.

"*The Swedish Industrial Development Fund and IT Provider invest in Cypak*"; web page article from http://64.233.179.104/search?q=cache:rKf2CZYzvIoJ:cypak.vnewscenter.com/press.jsp%3Fid%3 . . . ; Aug. 18, 2004, www.cypak.com, Cypak AB, Funckens Gränd 1, Box 2332, 103 18 Stockholm, Sweden.

Conference Report: "*Smarter Packaging*", *Packworld.com Packaging World Magazine*; web page article from http://www.packworld.com/articles/Features/18411html, Nov. 2004.

The Endpaper, "RFID Tags and ALA", p. 9, Library Binding Institute, 14 Bay Tree Lane, Tequesta, FL 33469 (May 2005).

MSN search "acousticmagnetic" listing Sentech Acousto-Magnetic (AM) Tags, www.sentecheas.com (search conducted Aug. 12, 2004).

Sentech EAS Corporation, Product Listings (2 pages), RF Technology (1 page), and About Sentech (1 page), www.sentecheas.com, (prior to Apr. 14, 2004).

"*About SenTech*"; web page article from http://www.sentecheas.com/about.htm; www.cypak.com, Sen Tech EAS Corporation, 2843 Centerport Circle, Pompano Beach, FL 33064; at least as early as Apr. 2004.

"Intelligent Pharmaceutical Packaging"; "*Summary*" and IPP PowerPoint™ presentation from http://www.cypak.com/index.php?a=product&b=ipp&c=summary&page=products_ipp; www.cypak.com, Cypak AB, Funckens Gränd 1, Box 2332, 1103 18 Stockholm, Sweden; at least as early as Apr. 2004.

"Intelligent Pharmaceutical Packaging"; "*Articles*"; web page article from http://www.cypak.com/index.php?a=pressroom&b=articles&page=pressroom_articles; www.cypak.com, Cypak AB, Funckens Gränd 1, Box 2332, 103 18 Stockholm, Sweden; at least as early as Apr. 2004.

"*The Connected Drug Box*"; web page article from http:. . . web.archive.org/web/20021209044120/cypak.com/index.php?a=pressroom&b=news&page. . . ; www.cypak.com, Cypak AB, Funckens Gränd 1, Box 2332, 103 18 Stockholm, Sweden; at least as early as Apr. 2004.

"*Electronic Compliance Packaging*"; web page article from http://web.archive.org'web/20030409195629/www.cypak.com/index.php?a=products&b=packaging&page=products_packaging; www.cypak.com, Cypak AB, Funckens Gränd 1, Box 2332, 1003 18 Stockholm, Sweden; at least as early as Apr. 2004.

"*We are innovators. . . "*; web page article from http://web.archive.org/web/20031206192144/http://cypak.com; www.cypak.com, Cypak AB, Funckens Gränd1, Box 2332, 103 18 Stockholm, Sweden; at least as early as Apr. 2004.

KR 535 Tabmaster Product Flyer, "*The KR 535 makes tabbing of paper products faster and easier than ever. Here's why . . .* ", Kirk Rudy, Inc., 2700 Kennesaw Due West Road, Kennesaw, GA., USA 30144; at least as early as Apr. 2004.

KR 203P Attaching System Product Flyer, "*The KR 203P attaches a wide variety of cards and pre-packaged samples onto various mailers and inserts"*, Kirk Rudy, Inc., 2700 Kennesaw Due West Road, Kennesaw, GA., USA 30144; at least as early as Apr. 2004.

* cited by examiner

INTERMEDIATE COVER BOARD WITH CONCEALED SECURITY DEVICE FOR HARD COVER PRODUCT

This application is a continuation of patent application Ser. No. 10/886,355, filed Jul. 7, 2004, U.S. Pat. No. 7,183,918, which present application claims benefit of provisional patent application Ser. No. 60/562,586, filed Apr. 14, 2004, and incorporates same herein by reference.

TECHNICAL FIELD

The present invention relates to hard cover products. More particularly, the present invention relates to an intermediate liner with a concealed security device for facilitating manufacture and use of hard cover products.

BACKGROUND OF THE INVENTION

In recent years, tracking of inventory of goods has become of increased importance. Inventory of goods represents a significant investment in capital. In addition to cost factors, other aspects prompting increased interest in tracking inventory include the increase in just-in-time manufacturing in which materials are provided by suppliers shortly prior to the time of use by the manufacturer of goods, as well as theft deterrence and inventory verification and auditing.

Various electronic and mechanical devices have been provided for tracking and monitoring of goods and containers. These devices include acoustic magnetic security strips and radio frequency security tags. These devices often are embodied in tags, pods, labels, or patches, having adhesive surfaces for attaching the device to the goods or their containers. These devices facilitate tracking and monitoring of goods and containers. The security devices are typically attached to the articles particularly susceptible to pilferage and improper removal from a warehouse or retail store. The security devices include a detectable sensor. One known type of security tag has a circuit that resonates at a predetermined detection frequency range. A transmitter provides electromagnetic energy that excites the circuit. A receiver detects the output signal from the resonating circuit. The transmitter and the receiver are located at detection points, often exits from retail facilities. As the article is carried through the detection point, the receiver signals an alert when an activated sensor device is detected. For articles that are permitted to pass (such as purchased articles), a separate device is used to deactivate the detectable sensor prior to passage. Other devices include RFID devices that communicate digital signals. In some known RFID devices, the signal is indicative of unique identifiers for tracking particular containers.

Often large retailers require manufacturers of articles to include tracking and monitoring devices within the containers for the articles. For smaller retailers and smaller inventories of articles, the tracking and monitoring devices may not be included with or attached to containers. In such circumstances, the articles may be provided with after-market tracking and monitoring devices. For example, electronic article surveillance tags are available with adhesive backing to secure the tags to the containers. While the containers are thereby subject to electronic article surveillance, the adhesively attached tags experience problems during use. One significant problem is that the tags, being on the exterior of the container, are susceptible to removal. Removing the security tag facilitates unauthorized removal of the article from the secured area. However, removal by a purchaser also causes problems. The covering to which the security tag attaches may become torn or ripped. The package with the security tag, or without such by removal, is unattractive. The security tag may also overlie or cover over ornamental graphics or text on the packaging.

Also, importantly, the attachment of an electronic security tag to an interim assembly of an article during manufacture lead to production and handling problems. The security tag projects from the surface to which it attaches. This causes stacked ones of the interim assemblies to gradually angle or tip as the stack height increases with placement of additional interim assemblies. For example, hard cover books assembled using casing machines receive an outer liner that attaches to front cover stock and back cover stock. Such interim assemblies are stacked for a second pass through the casing machine to apply an inner liner. Angled stacks make production and handling more difficult during manufacturing. Further, the protruding security tag may scratch the adjacent assembly, for example, when a feeder device pushes one of the assemblies from a hopper for processing and applying the inner liner.

Accordingly there is a need in the art for providing hard cover products with concealed security tracking and monitoring devices. It is to such that the present invention is directed.

SUMMARY OF THE INVENTION

The present invention meets the need in the art by providing an intermediate cover board for hard cover products, in which a primary sheet having a first thickness and opposing planar surfaces defines a receiving cavity in a selected portion of the sheet. The receiving cavity receives a security device. The cover board thereafter is suitable for overlay by a cover liner during manufacture of a hard cover product.

In another aspect, the present invention provides a laminated cover board for hard cover products in which a primary sheet having a first thickness and opposing planar surfaces defines a receiving cavity in a selected portion of the sheet, which cavity receives a security device. A pair of opposing secondary sheets each with a second thickness less than the first thickness are laminated to the opposing planar surfaces of the primary sheet. The security device is thereby enclosed between the laminated secondary sheets of the second thickness sufficient that the assembled intermediate laminated cover board does not display surface indications of the presence of the security device.

In another aspect, the present invention provides a method of assembling an intermediate laminated board for subsequent use as a component of hard cover products, comprising the steps of:

(a) providing a primary sheet having opposing planar surfaces with a length and width exceeding a first thickness, the primary sheet defining an opening therethrough in a selected portion thererof;

(b) laminating a first exterior sheet to a first of the opposing planar surfaces and closing the opening in the primary sheet;

(c) positioning a security device in the opening, the security device having a thickness no greater than about a substantial majority of the thickness of the central sheet so that opposing sides thereof are no more than substantially coplanar with respective ones of the opposing planar surfaces of the central sheet; and (d) laminating a second exterior sheet to the second of the opposing planar surfaces to form an intermediate laminated board that does not display on the opposing surfaces defined by the exterior sheets indications of the presence of the security device therein. The resulting laminated cover board is gainfully used as a cover board in a hard cover product having an outer cover and an inner liner while not displaying indications of the enclosed security device.

Objects, advantages and features of the present invention will become apparent from reading of the following detailed description of the invention and claims in view of the appended drawings.

DETAILED DESCRIPTION

Figure 1:
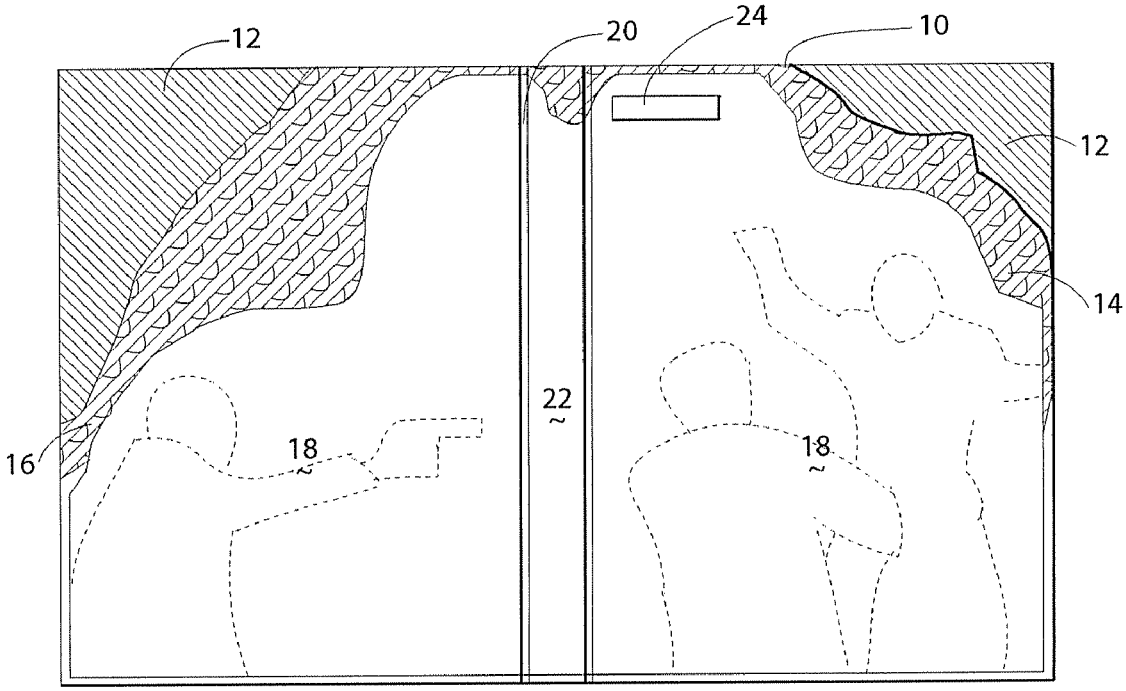
Fig. 1 Prior Art
FIG. 1 is a plan view of a hard cover product in which a security device is attached to an exterior surface.
Figure 2:
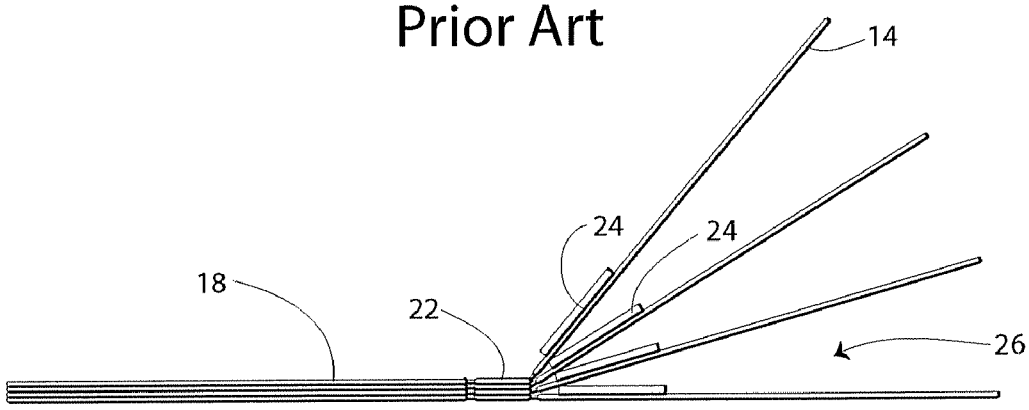
Fig. 2 Prior Art
FIG. 2 is an end view of a stack of assemblies used to make a hard cover product illustrated in FIG. 1.

Referring now in more detail to the drawings in which like numerals refer to like parts throughout the several views, FIG. 1 illustrates a hard cover product 10 having an outer liner 12, a pair of spaced-apart sheets 14, 16, and covered by an inner liner 18. The enclosed sheets 14, 16 define front and back covers for the product. A pair of spaced-apart grooves or scores 20 enable the sheets 14, 16 to fold together to close the hard cover product 10. A gap 22 between the scores 20 defines a spine or back of the closeable hard cover product 10. A security sensor 24 attaches with adhesive to the face of the inner liner 18 in a selected position. The sensor extends above the surface defined by the inner liner 18. As illustrated in FIG. 2, this can lead to handling and production problems during manufacture of the hard cover product 10. The upwardly extending security sensor causes a portion of the stack to be disposed an oblique angle 26, rather than lying flat. This uneven stack makes handling of work in progress more difficult.

Figure 3:
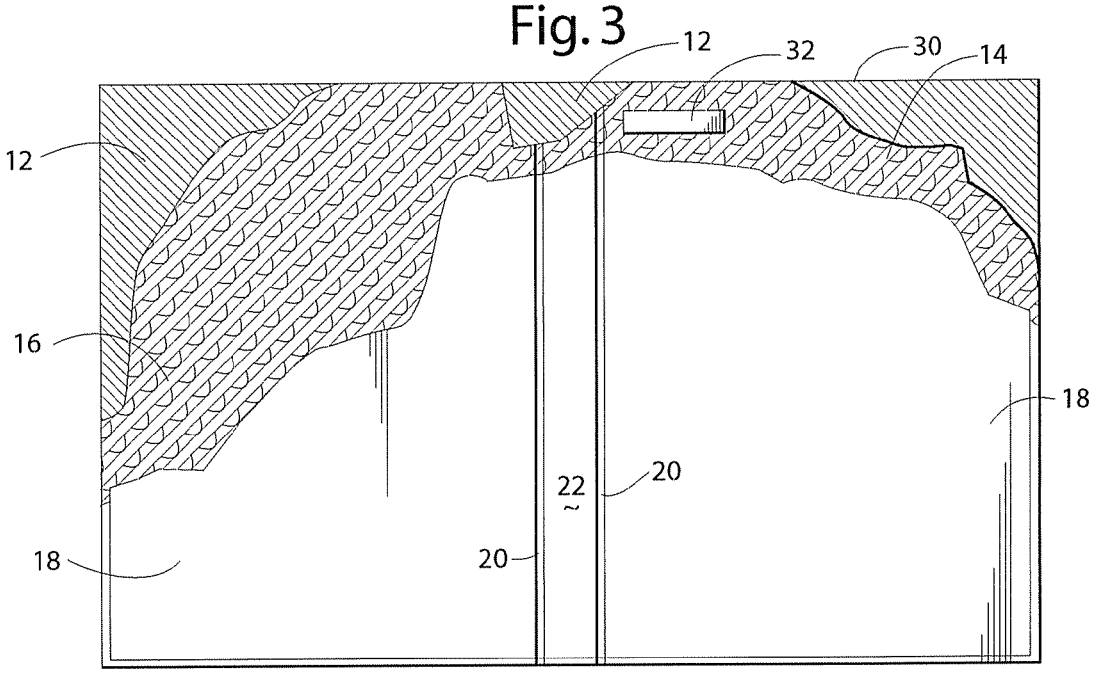
FIG. 3 is a plan view of an embodiment of the present invention providing a hard cover product with a concealed security device.
Figure 4:
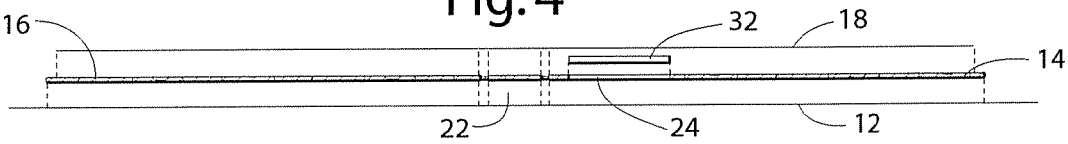
FIG. 4 is an exploded edge view of the hard cover product assembly illustrated in FIG. 3.

FIG. 3 illustrates a bard cover product 30 according to the present invention in which the security sensor 24 is concealed within an assembly of the outer liner 12, the sheets 14, 16, and the inner liner 18. FIG. 4 is an exploded edge view of the hard cover product assembly illustrated in FIG. 3. A recess 32 is formed in the sheet 14 such as by die cutting the sheet in a casing operation typical for binding of books using a casing machine. An applicator apparatus places the security sensor 24 within the recess 32. The outer liner 12 closes the recess 32 from an exterior side of the assembly for the hard cover product 30, and the inner liner 18 closes the recess 32 from the opposing interior side. The inner liner 18 thereby conceals the security device 24 within the hard cover product 30.

The thickness of the sheet 14 (on a line 34 shown in FIG. 4 transverse through the opposing major surfaces) is preferably sufficient that the security device 24 is recessed in the recess 32 relative to the major surfaces. The sheets 14, 16 are cardboard sheet, fiberboard sheets, or other stiff or hard sheet material suitable for forming a cover to a book, casing, or other article-container.

In the illustrated embodiment, the gap 22 defines scores or grooves in the overlapped inner and outer lines 12, 18. These define pivots or lines on which the front and back covers fold together.

Figure 5:
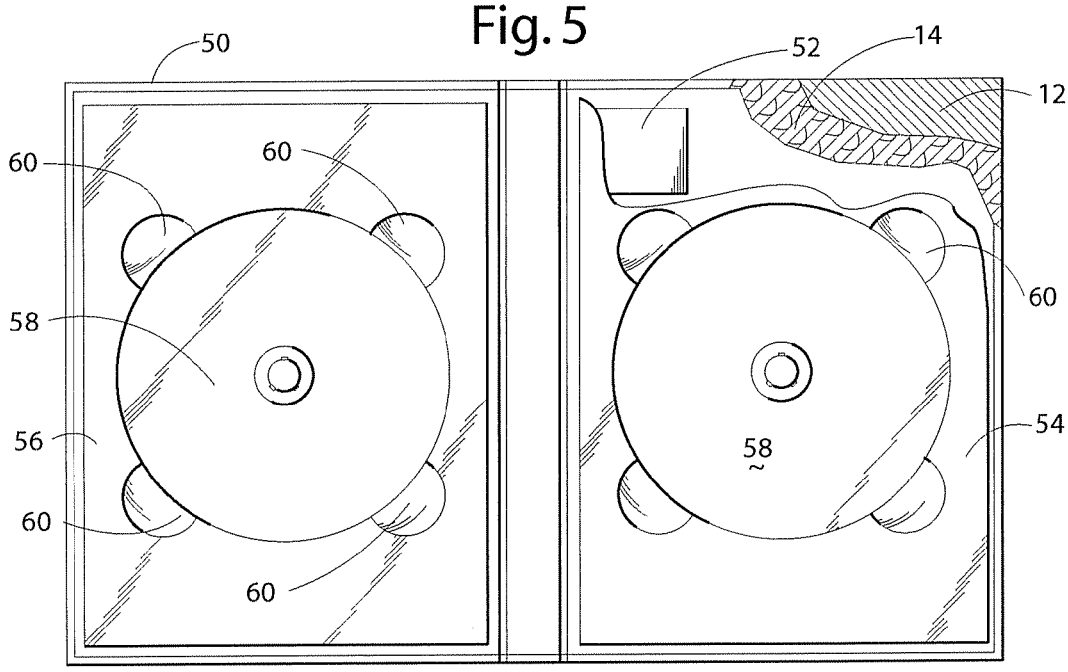
FIG. 5 is a plan view of an alternate embodiment of the hard cover product according to the present inversion.

FIG. 5 illustrates an alternate embodiment of a hard cover product 50 according to the present invention. In this embodiment, a substantially planner radio frequency tag 52 attaches to the surface of the sheet 14*a*. The inner liner 18 attaches in overlaying relation to the sheets 14, 16. In the illustrated embodiment, which does not include the recess 32, the inner liner 18 extends over the area of the spine. The inner liner 18 thereby overlies and concealingly encloses the sheet-like security tag 52. The security tag 52 is perceptible as a slight bulge, but generally does not detract from the graphics or text on the inner liner.

Figure 8A:
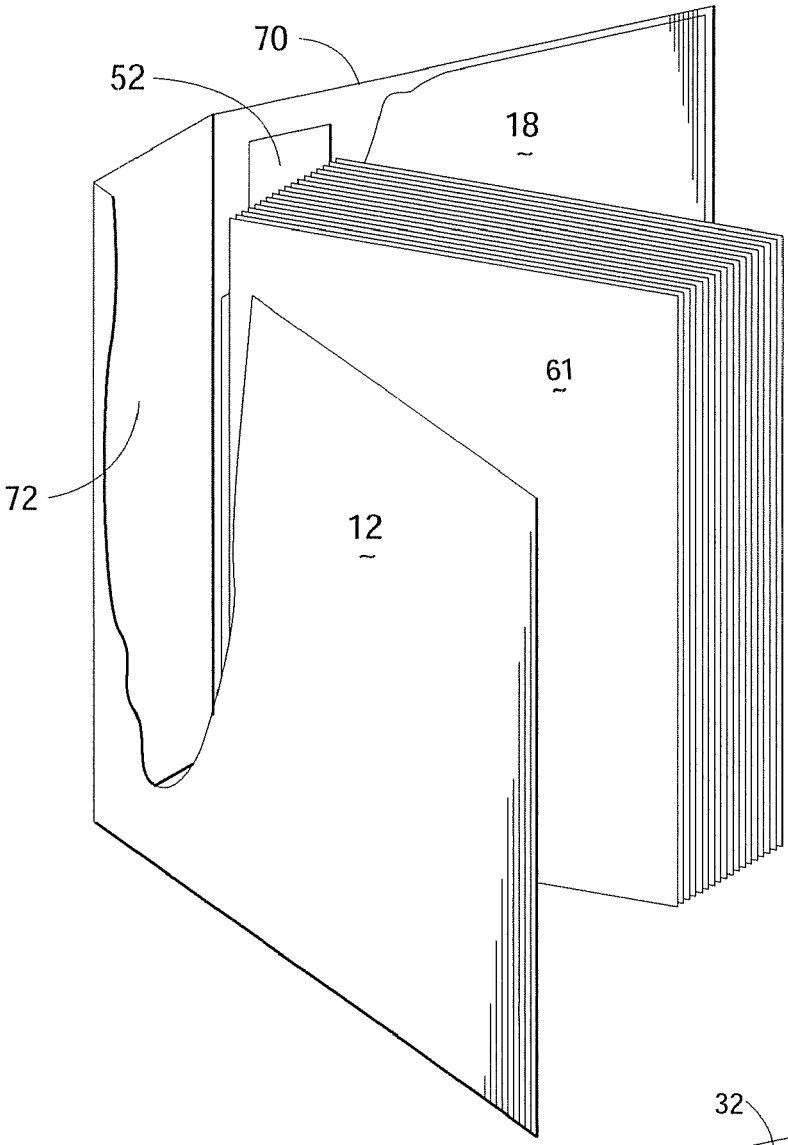
FIGS. 8A and 8B are perspective views of a hard cover product with a bound assembly of papers for a book.
Figure 8B:
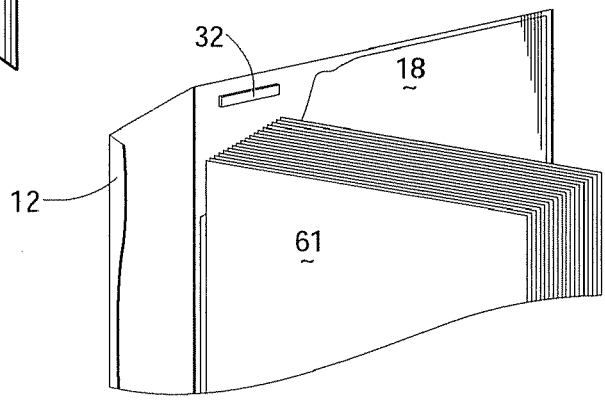

In the illustrated embodiment, the hard cover product 50 attaches to an interior body, such as plastic matingly engagable plastic diskholders, configured for receiving compact discs or DVD discs. However, the interior body may be a bound assembly of papers for a book. Other shell devices that define an interior body for the hard cover product may be gainfully attached to the interior front and back covers, such as for packaging small articles, video tapes, books, ring binders, or other articles. For example, FIGS. 8A and 8*b* illustrate a bound assembly 61 of paper sheets containing printed material to be bound in the hard cover product as a book. The bound assembly 61 attaches to the spine 22.

Figure 6:
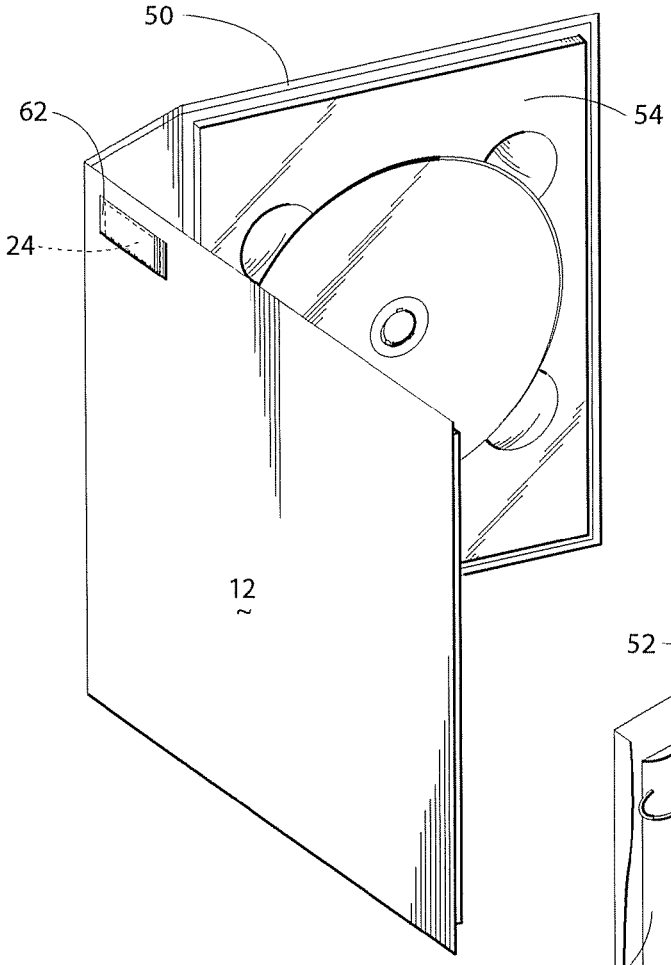
FIG. 6 is a perspective view of a hard cover product illustrating features of the present invention.

FIG. 6 illustrates the hard cover product 50 in which the outer liner 12 includes an indicia 62 such as a bar code or other product inventory number. In this embodiment, the recess 32 for the security tag 24 (or security tag 52 attached to the sheet 14) is disposed substantially in alignment with the indicia 62. In this way, a security tag detector deactivates the security tag when the hard cover product 30 is scanned for pricing, so that the product can be taken from a store without triggering alarms.

Figure 7:
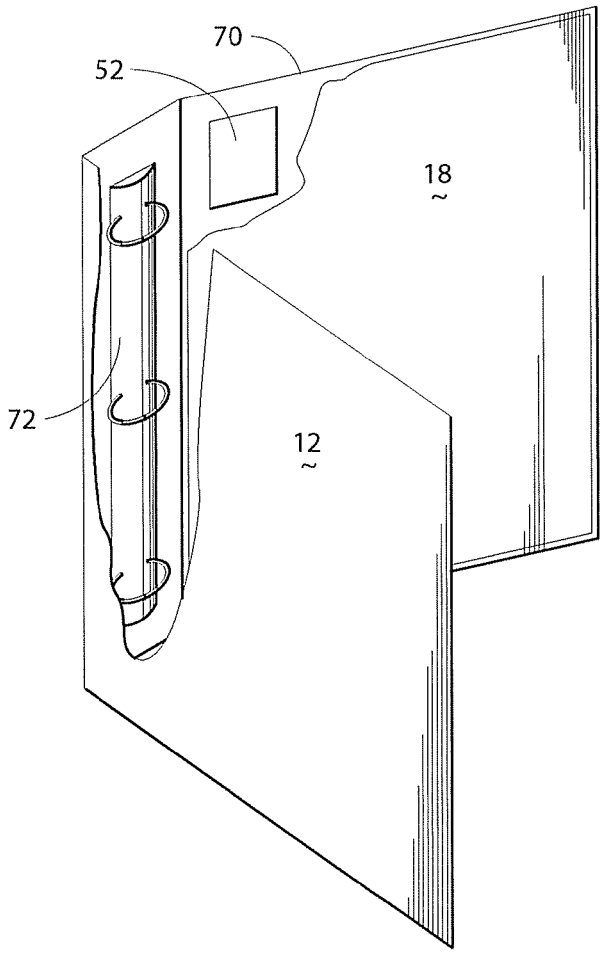
FIG. 7 is a perspective view of an alternate embodiment of the hard cover product according to the present invention.

FIG. 7 illustrates an alternate embodiment of a hard cover product 70 that includes a three-ring binder assembly 72. In this embodiment, the sheet 14 receives one of the sheet-like security devices 52, although in an alternate embodiment, the sheet defining front (or back) cover includes the recess 32.

Figure 9:
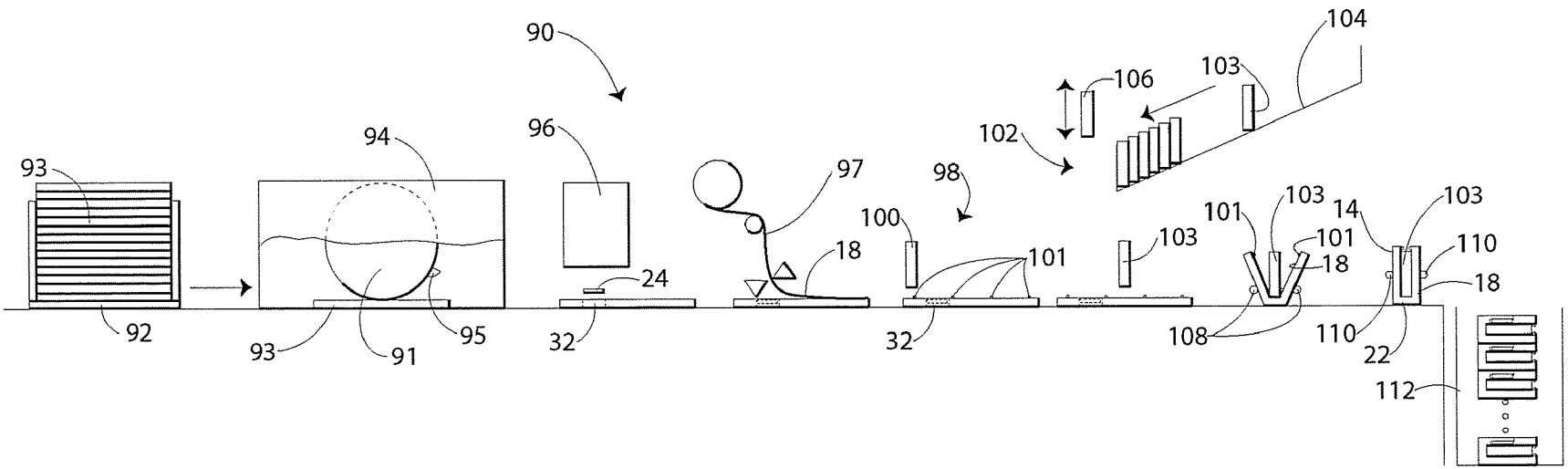
FIG. 9 is a schematic illustration of an assembly line for manufacturing hard cover products of the present invention.

FIG. 9 is a schematic illustration of an assembly line 90 for manufacturing hard cover products of the present invention discussed above. The assembly line 90 includes a supply hopper 92 that receives a stack 93 of interim assemblies of the hard cover product. A casing machine 94 operates to cut blanks of cardboard sheets to define the front and back cover bodies enclosed in the outer and inner liners. The casing machine 94 also includes a rotatatable cylinder 91 with a cutter 95 for slitting open the recess 32. An interim assembly of the hard cover product includes the outer liner 12 attached to the sheets 14, 16. A label applicator 96 receives a supply of security tags 24 and positions one in the recess 32 or on the sheet 14 (for a sheet type security tag). Operation of the assembly line in a first stage of manufacture results in interim assemblies that are subsequently returned to the hopper for attaching the inner liner 18.

The assembly line 90 further includes an inner liner application station 97 in which the inner liner 18 is attached in overlying relation to the major surfaces of the sheets 14, 16 opposing the outer liner 12. A glue station 98 includes an adhesive applicator 100 for depositing a selected adhesive 101 to the inner liner 18. A casing applicator 102 includes a supply hopper 104 that holds a plurality of interior bodies or casings 103, such as the engageable shells 54, 56. A metering device 106 causes one of the casings 103 to be positioned on the spine 22. Opposing ploughs 108 guide the opposing front and back covers to pivot together to foldingly close the hard cover product. Rollers 110 bear against the opposing covers to close the hard cover product and to force the casing 103 into engaging contact with the adhesive. The completed, closed hard cover product then is received in a stacker 112 for packaging.

Figure 10:
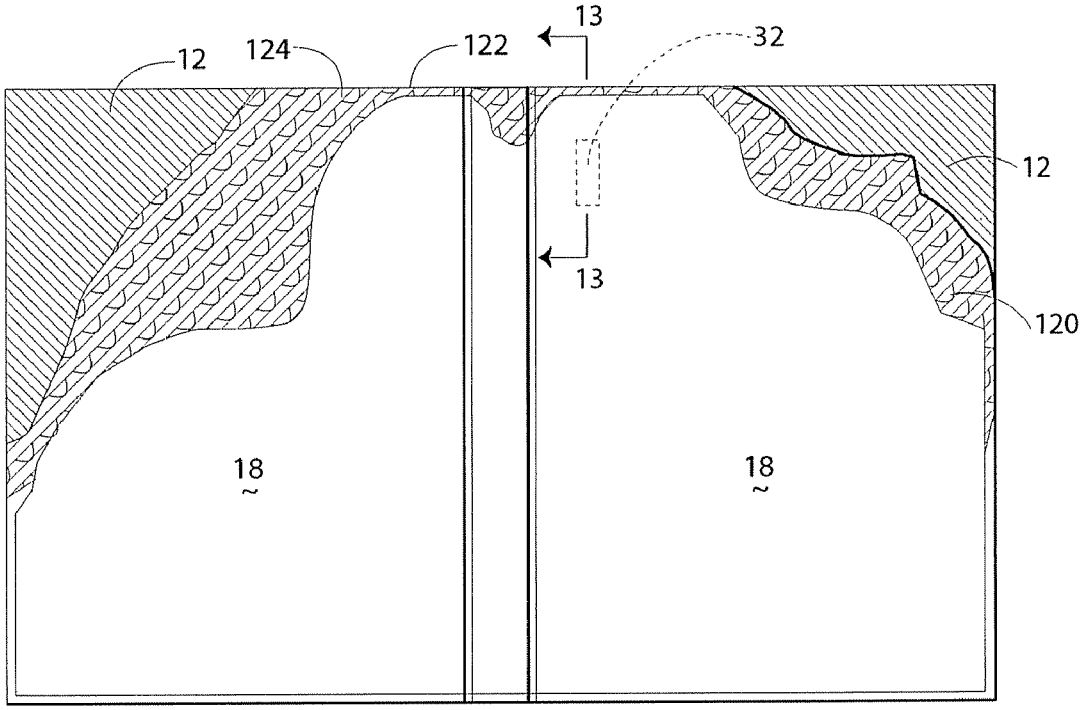
FIG. 10 is a plan view of a hard cover product in which a security device is enclosed in an intermediate laminated cover board according to the present invention.

While the hard cover product 10 described above provides the enclosed and concealed security sensor 24, the exterior surfaces of the outer liner 12 and the inner line 18 tend to include indications of the presence of the security sensor contained therein. These indications include a subtle but noticeable border defined by the edge of the recess 32, a shallow depression in the outer liner 12 or the inner liner 18 in the proximity of the recess, or a shallowly bulging portion proximate to the recess. The present invention provides in another aspect as illustrated in FIG. 10, an intermediate laminated cover board 120 that does not display surface indications of the presence of the security sensor or device 32 enclosed within a hard cover product 122 assembled using the intermediate laminated cover board. The hard cover product 122 includes the outer liner 12, a cover board 124, the intermediate laminated cover board 120 disposed spaced apart therefrom, and an inner liner 18. The cover board 124 and the intermediate laminated cover board 120 overlaid with the outer liner 12 and the inner liner 18 define front and back covers for the hard cover product, such as a book, a binder, a disc enclosure, or the like product having an interior body. A gap between the spaced apart cover board 124 and intermediate laminated cover board 120 define a spine for the hard cover product 122 that closes by folding the opposing cover boards along line defined by the spine.

Figure 11:
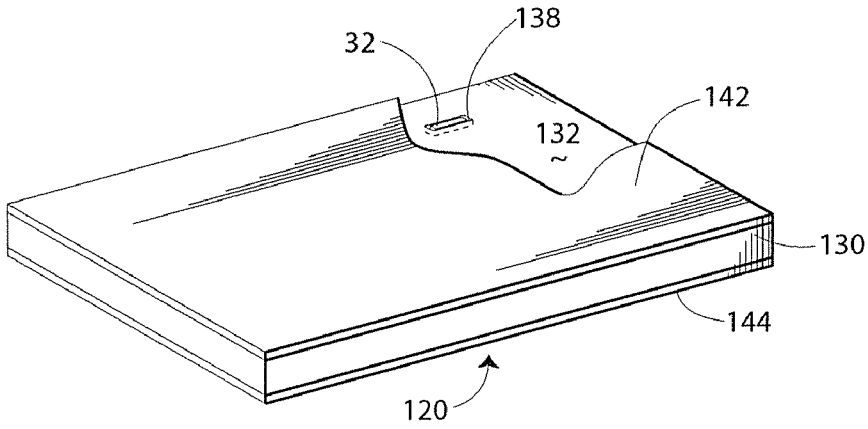
FIG. 11 is a perspective cut-away view of the intermediate laminated cover board illustrated in FIG. 10.
Figure 12:
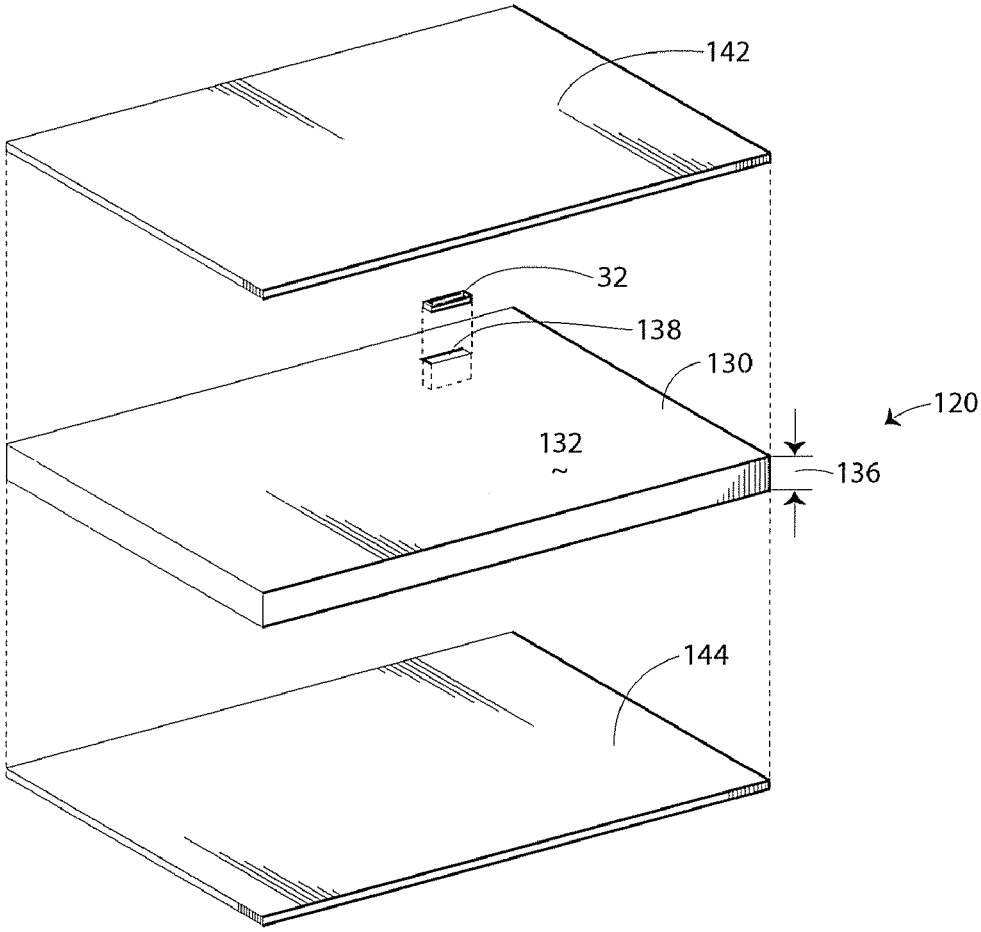
FIG. 12 is a perspective exploded view of the intermediate laminated cover board illustrated in FIG. 10.

With reference to FIGS. 11 and 12, the intermediate laminated cover board 120 (illustrated in perspective cut-away view and perspective exploded view, respectively), is gainfully used for assembling hard cover products 122. The intermediate laminated cover board 120 includes a primary or central sheet 130 having opposing planar surfaces 132, 134 with a length and width exceeding a first thickness 136. The central sheet 130 further defines an opening 138 through the central sheet. The opening 138 is formed by a die cutter such as a roller with an extending die that bears upon the cover board as it moves past the roller on a conveyor. The opening 138 is formed in a selected portion of the cover board, and particularly so that the outer cover 12 can be printed with an indicia such as a bar code that also directs the positioning of a security canceling device such as the scanners used at store checkout registers.

The security device 32 is received in the opening 138. In the illustrated embodiment, the security device 32 has a thickness generally no greater than about a substantial majority of the thickness of the central sheet 130, so that opposing sides of the security device 32 are substantially co-planar with respective ones of the opposing planar surfaces 132, 134 of the central sheet, as best illustrated in cross-sectional view in FIG. 13, taken along line 13-13 of FIG. 10.

A pair of opposing exterior sheets 142, 144 attach with an adhesive as a lamination to respective opposing planar surfaces 132, 134 of the central sheet 130. The exterior sheets 142, 144 each have a respective second thickness that less than the first thicknessl36. The laminated exterior sheets 142, 144 thereby enclose the security device 32 in the opening 138 and between the exterior sheets. The thickness of the exterior sheets 142, 144 is sufficiently sized so that the laminated intermediate cover board 120 does not display surface indications of the presence of the security device 32. The security device 32 thereby enclosed in the central sheet 130 is concealed from casual indication of its presence.

The central board 130, as well as the exterior boards 142, 144 are made of a semi-rigid sheet material, such as chip board, pasted chip board, card board, grey fibreboard, or the like material used for cover boards for books, backings for note pads, and the like products.

Figure 13:
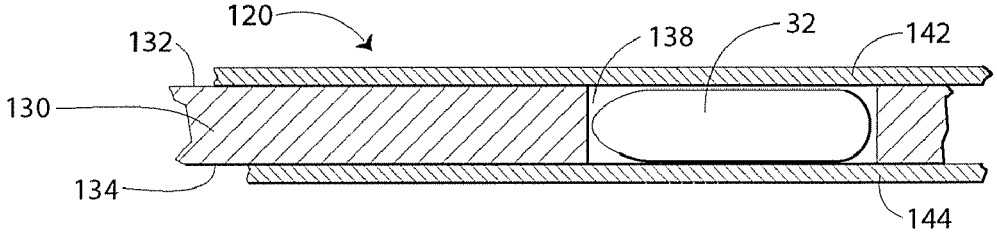
FIG. 13 is a partial cross-sectional view of the intermediate laminated cover board illustrated in FIG. 10, taken along the line 13-13.

With reference to FIGS. 11-13, the center board 130 and the exterior boards 142, 144 intermediate together to produce the laminated board 120 f)r subsequent use as a component of hard cover products. The central sheet 130 is provided with the opening 138 such as by a die cutter extending through the opposing surfaces in the selected portion. The exterior sheet 144 then laminates with an adhesive to the planar surface 134. This closes the opening 138 on one side. The security device 32 is positioned in the opening 138. As illustrated in FIG. 13, the security device 32 preferably has a thickness no greater than about a substantial majority of the thickness of the central sheet 130 so that opposing sides are no more than substantially co-planar with the opposing planar surfaces 132, 134 of the central sheet. The second exterior sheet 142 laminates to the planar surface 132 to enclose the security device 32 and to form an intermediate laminated board 130 that does not display on the opposing surfaces defined by the exterior sheets indications of the presence of the security device in the intermediate laminated board 130.

In an example, the central board 130 has a length of 7½ inches, a width of 5¾ inches, and a thickness of 0.060 inches. The opening 138 is cut 1 inch from the head of the central board 130 and is centered laterally. A commercially available type of security device has a thickness of about 0.056 inches. The exterior boards 142, 144 conform in length and width to the central board, and have a thickness of about 0.010 inches. In an alternate embodiment, the central board 130 can be left open on one side, by using one exterior board having a thickness of about 0.020 inches, which may be a less expensive embodiment of the invention. Other embodiments are readily apparent to those of ordinary skill in the art of forming hard cover products.

With reference to FIG. 10, the intermediate laminated cover board 130 readily assembles with the cover board 124, the outer cover 12, and the inner cover 18, as discussed above to form the foldable hard cover product 122 to enclose the security device 32 while not having casually observable surface indications as to the security device.

Figure 14:
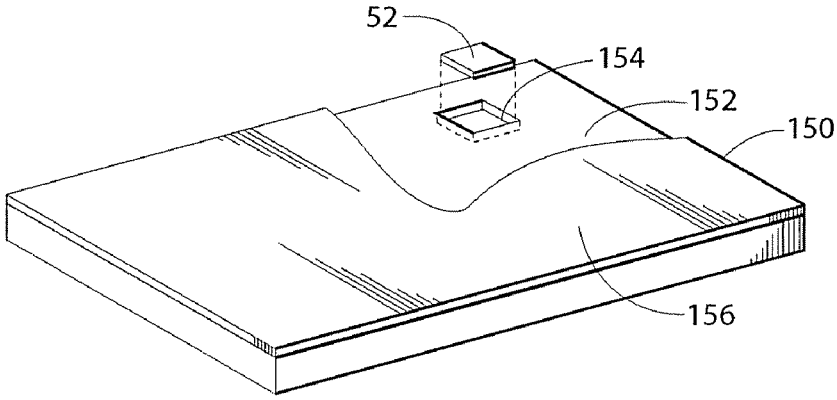
FIG. 14 illustrates in perspective view an alternate embodiment of the intermediate laminated cover board using a sheet type security device in accordance with the present invention.
Figure 15:
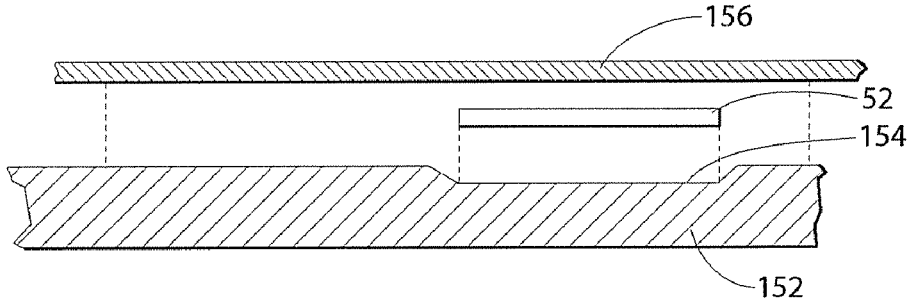
FIG. 15 illustrates in cross-sectional side view the alternate embodiment of the intermediate laminated cover board shown in FIG. 14.

FIG. 14 illustrates in perspective cut-away view an alternate embodiment of a intermediate laminated cover board 150 using a sheet-type security device such as the planar radio frequency tag 52 while not displaying surface indications of the presence the security device. FIG. 15 illustrates in cross-sectional exploded side view the intermediate laminated cover board 150 which defines a shallow recess 154. The recess 154 has a bottom surface and is formed in the cover board by a deboss process. The recess 154 results from passing the cover board 152 between a roller having a projection and a pressure plate, which projection compresses the selected portion of the cover board in order to define the shallow recess 154 therein. The recess 154 thereafter receives one of the planar radio frequency tags 52. The depth of the deboss recess 154 is about the thickness of the radio frequency tag 52, but generally is sufficiently compressed so that an exterior surface of the radio frequency tag 52 is coplanar or recessed relative to a surface of the cover board 152 around the recess. A liner board 156 attaches with adhesive in overlaying relation and enclosing the radio frequency tag 52 in the recess with little if any exterior surface indication of the presence of the security device enclosed within the laminated structure. It is to be appreciated that with respect to FIG. 15, the security sensor (radio frequency tag 52) is totally concealed before a cover 12 and inner liner 18 are applied. The intermediate cover board 150 may also be supplied to a manufacturer of hard cover products (such as a book binder) without the laminated cover liner 156 for application by the binder of the cover 12 and liner 18. This alternate embodiment with the recess 154 may have slight surface indications of the security tag after application of the cover 12.

Figure 16:
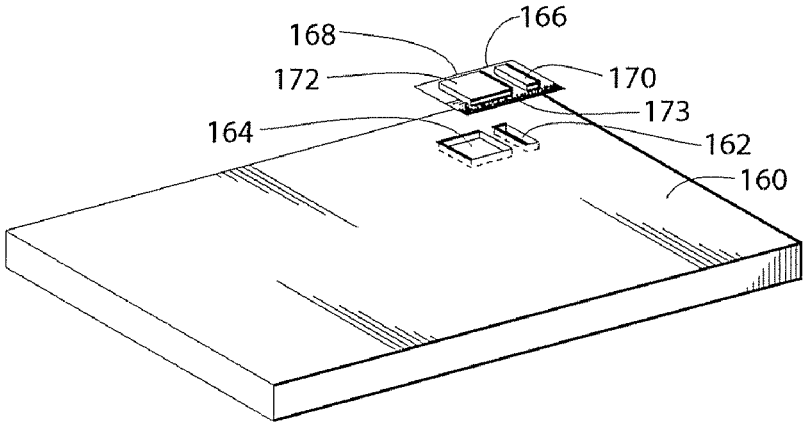
FIG. 16 illustrates in perspective exploded view an alternate embodiment of an intermediate cover board that features a combination dual security device in accordance with the present invention.

FIG. 16 illustrates in perspective exploded view an alternate embodiment of an intermediate cover board 160 that accommodates a combination security device 166. The cover board 160 defines a slot 162 and an adjacent recess 164. The slot 162 is die cut through the cover board 160 while the recess 164 is debossed therein as discussed above. The combination security device 166 includes a backing sheet 168 with an acoustic magnetic security bar 170 and a planar radio frequency tag 172. A perimeter portion of the combination security tag 166 includes an adhesive coating 173.

For purposes of illustration, FIG. 16 illustrates the combination security tag 166 with the security bar 170 and the planar radio frequency tag 172 disposed in a direction away from the cover board 160. When installed, the combination security device 166 is disposed towards the cover board 160 with the security bar 170 received in the slot 162 and planar sheet radio frequency tag 172 disposed in the recess 164, respectively. The adhesive coating 173 on the perimeter secures the combination security tag 166 in place.

While not illustrated, it is to be appreciated with reference to FIG. 11 and 12 that the combination security tag 166 can be enclosed by laminating a cover liner 142 to the cover board 160, and further in an alternate embodiment, a pair of opposing cover boards 142, 144 can be laminated to opposing sides of the cover board 160. The embodiment illustrated in FIG. 16 is gainfully used in facilities (such as stores or libraries, as examples) having one or both of such security detection devices. The intermediate cover board 160 including the security device 166 is provided to manufacturers of hard cover products for applying cover liners 12 and inner liners 18. The resulting hard cover product has reduced surface indications of the presence of the hidden enclosed security device or with the cover liner 142, 144, the product lacks observable indications of the enclosed security device. The manufacturer of hard cover products can select an embodiment having the cover liners 142, 144, or the single layer intermediate cover board.

This specification has described the present invention that provides the intermediate laminated cover board useful in making hard cover products with concealed security devices, including the steps necessary for making and using various embodiments thereof. It is to be understood, however, that numerous changes and variations may be made in the construction of the present hard cover product within the spirit and scope of the present invention, and that modifications and changes may be made therein without departing from the scope thereof as set forth in the appended claims.

What is claimed is:

1. An intermediate laminated cover board for use by bindery manufacturers of hard cover products, which manufacturers receive the intermediate laminate cover board and in combination with other cover board, with cover and liner sheets, and with body content, assemble same into a hard cover product, comprising:

a primary sheet of a chipboard cut to a selected size and having a first thickness and opposing planar surfaces and defining a receiving cavity in a selected portion of the primary sheet;

a security device received in the receiving cavity;

a pair of opposing secondary sheets each having a second thickness less than the first thickness laminated to the opposing planar surfaces of the primary sheet, whereby the security device is enclosed between the laminated secondary sheets of the second thickness sufficient that the assembled intermediate laminated cover board does not display surface indications of the presence of the security device therein, for providing as a stack of intermediate cover boards to bindery manufacturers to use in combination with other cover boards, with cover and liner sheets, and with body content, to assemble same into a hard cover product.

2. The intermediate laminated cover board as recited in claim 1, wherein the security device has a thickness no greater than about a substantial majority of the thickness of the primary sheet.

3. The intermediate laminated cover board as recited in claim 1, wherein the security device is aligned in the receiving cavity such that opposing surfaces thereof are substantially co-planar with the planar surfaces of the primary sheet.

4. The intermediate laminated cover board as recited in claim 1, wherein the receiving cavity comprises a die-cut opening and the security device has a thickness no greater than about a substantial majority of the thickness of the primary sheet.

5. The intermediate cover board as recited in claim 4, wherein the security device is aligned in the opening such that opposing outward surfaces thereof are substantially co-planar with the planar surfaces of the primary sheet.

6. The intermediate cover board as recited in claim 1, wherein the receiving cavity comprises a debossed recess and the security device comprises a sheet member having a thickness no greater than about a substantial majority of the depth of the debossed recess relative to a majority planar portion of the primary sheet.

7. The intermediate cover board as recited in claim 6, wherein the security device is aligned in the debossed recess such that an outward surface thereof is substantially co-planar with a planar surface of the primary sheet.

8. An intermediate laminated board for use by bindery manufacturers of hard cover products, which manufacturers receive the intermediate laminate board and in combination with other cover board, with cover and liner sheets, and with body content, for assembling hard cover products, comprising:

a central sheet of a chipboard cut to a selected size and having opposing planar surfaces with a length and width thereof exceeding a first thickness, the central sheet defining an opening therein in a selected portion thereof;

a security device received in the opening, the security device having a thickness no greater than about a substantial majority of the thickness of the central sheet so that opposing sides thereof are substantially co-planar with respective ones of the opposing planar surfaces of the central sheet;

a pair of opposing exterior sheets, each having a respective second thickness less than the first thickness laminated to the opposing planar surfaces of the central sheet and thereby enclosing the security device there between, the second thickness sufficiently sized so that the laminated board does not display surface indications of the presence of the security device therein, whereby the security device enclosed in the central sheet is concealed in the intermediate laminated board from casual indication of its presence, whereby a stack of a plurality of said intermediate laminated boards are provided to bindery manufacturers to use in combination with other cover boards, with cover and liner sheets, and with body content, to assemble same into a hard cover product.

9. A method of assembling an intermediate laminated board for subsequent use by bindery manufacturers as a component of hard cover products, which manufacturers receive the intermediate laminate cover board and in combination with other cover board, with cover and liner sheets, and with body content, assemble same into a hard cover product, comprising the steps of:

(a) providing a primary sheet of a chipboard cut to a selected size and having opposing planar surfaces with a length and width thereof exceeding a first thickness, the primary sheet defining an opening therein in a selected portion thereof;

(b) laminating a first exterior sheet to a first of the opposing planar surfaces and closing the opening in the primary sheet;

(c) positioning a security device in the opening, the security device having a thickness no greater than about a substantial majority of the thickness of the central sheet so that opposing sides thereof are no more than substantially co-planar with respective ones of the opposing planar surfaces of the central sheet;

(d) laminating a second exterior sheet to the second of the opposing planar surfaces to form an intermediate laminated board that does not display on the opposing surfaces defined by the exterior sheets indications of the presence of the security device therein; and (e) stacking together a plurality of the intermediate laminated board and delivering same to a bindery manufacturer for use in combination with other cover board, with cover and liner sheets, and with body content, to assemble same into a hard cover product.

10. A hard cover product manufactured by a bindery manufacturer having an outer cover sheet adhesively attached to a first planar surface of a pair of chipboard cover boards disposed in spaced-apart relation, a first one of the pair of cover boards comprising an intermediate laminated board made in accordance with the method of claim 9, and spaced apart thereon to define a spine, and an inner liner sheet adhesively attached to respective opposing second planar surfaces of the cover boards to form a covered product, the spine joiningly engaging a body for the hard cover product.

11. The hard cover product as recited in claim 10, wherein the outer cover sheet carries an indicia disposed in alignment with the selected portion of the primary sheet, whereby a security canceling device is readily positioned in alignment with the concealed security device.

* * * * *